United States Patent [19]

Matthews

[11] Patent Number: 5,020,249

[45] Date of Patent: Jun. 4, 1991

[54] BUCKET FOR EXCAVATING BENEATH BURIED UTILITY LINES

[76] Inventor: Carl S. Matthews, 523 G NE., Miami, Okla. 74354

[21] Appl. No.: 367,565

[22] Filed: Jun. 19, 1989

[51] Int. Cl.[5] ..... E02F 5/02

[52] U.S. Cl. ..... 37/103; 37/118 R

[58] Field of Search ..... 37/103, 141 R, 141 T, 37/118 A, 118 R, 80 R, 2 R, 1; 405/154, 155, 156, 157

[56] References Cited

U.S. PATENT DOCUMENTS

| | | | |
|---|---|---|---|
| 2,857,065 | 10/1958 | Ferwerda | 37/103 X |
| 2,942,361 | 6/1960 | Pope | 37/103 |
| 4,639,183 | 1/1987 | Güthoff | 37/103 X |
| 4,676,013 | 6/1987 | Endo | 37/141 R X |

*Primary Examiner*—Dennis L. Taylor

*Assistant Examiner*—J. Russell McBee

*Attorney, Agent, or Firm*—Head & Johnson

[57] ABSTRACT

A bucket for excavating beneath buried utility lines having an elongated base portion, an upwardly curving back portion and a top portion. The inner edge of the back portion has a progressively decreasing radius and the outer edge of the back portion has a progressively increasing radius. The top portion includes couplers arranged in a plane angled in relation to the base portion. The bucket is designed to be utilized when repair work or new construction takes place in close proximity to existing utilities. It will remove earth around and under buried utility lines without use of hand shovels or boring machines. The plane and the radius are coordinated to simultaneously permit the utility line to clear the inner edge and the excavation to clear the outer edge as the bucket rotates about the couplers.

2 Claims, 2 Drawing Sheets

BUCKET FOR EXCAVATING BENEATH BURIED UTILITY LINES

SUMMARY OF THE INVENTION

In accordance with the invention, a bucket for excavating beneath buried utility lines has an elongated base portion, an upwardly curving back portion and a top portion. The inner edge of the back portion has a progressively decreasing radius and the outer edge of the back portion has a progressively increasing radius. The top portion includes couplers arranged in a plane angled in relation to the base portion. The bucket is designed to be utilized when repair work or new construction takes place in close proximity to existing utilities. It will remove earth around and under buried utility lines without use of hand shovels or boring machines. The plane and the radius are coordinated to simultaneously permit the utility line to clear the inner edge and the excavation to clear the outer edge as the bucket rotates about the couplers.

Another object of this invention is to facilitate excavation of materials not easily excavated by existing backhoe buckets such as heavy mud, clay and the like.

BRIEF DESCRIPTION OF DRAWINGS

Other objects and advantages of the invention will become apparent from the specification taken in conjunction with the accompanying drawings in which.

DETAILED DESCRIPTION OF THE INVENTION

Figure 1:
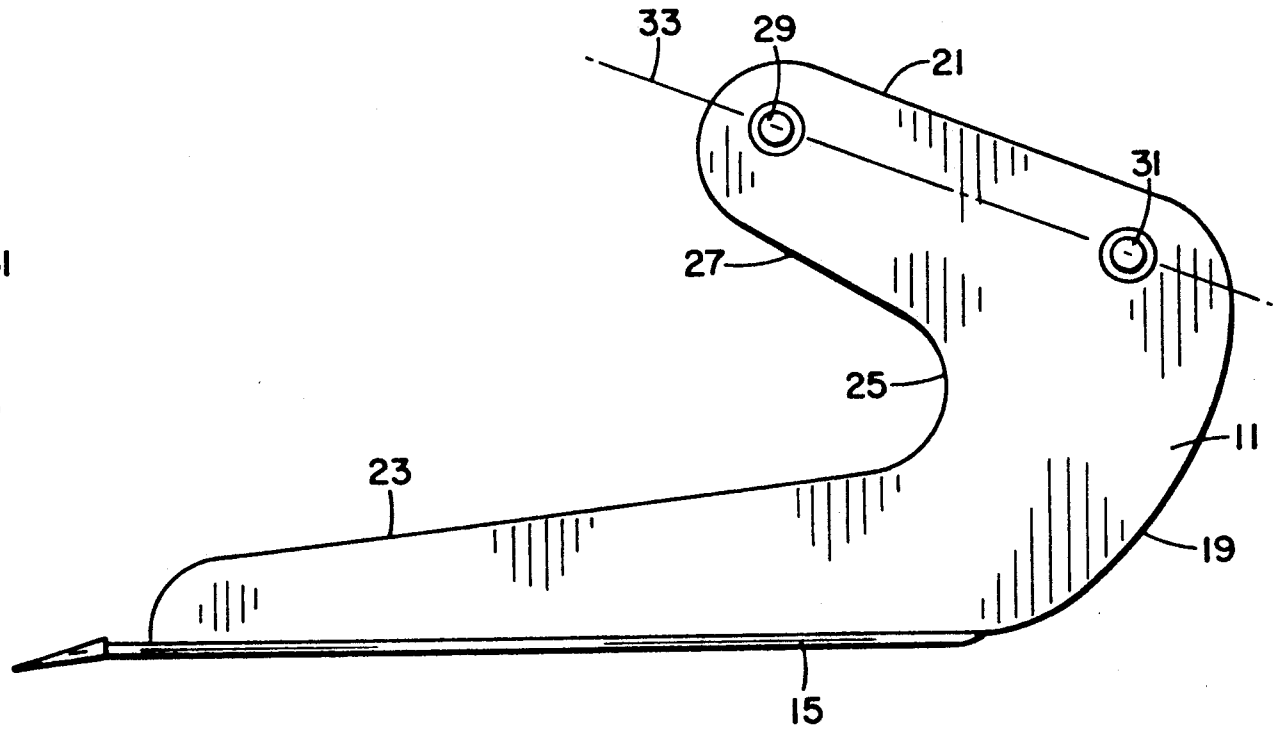
FIG. 1 is a side elevational view of a preferred embodiment of the utilities bucket.
Figure 2:
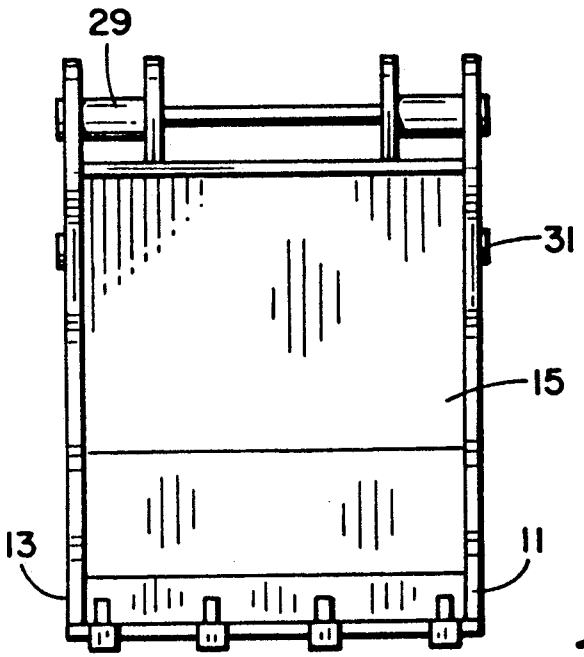
FIG. 2 is a front view of the utilities bucket of FIG. 1.
Figure 3:
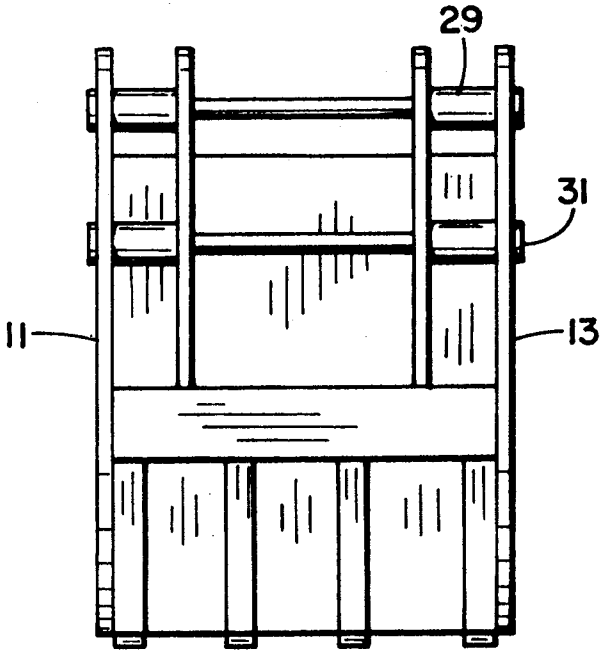
FIG. 3 is a rear view of the utilities bucket of FIG. 1.
Figure 4:
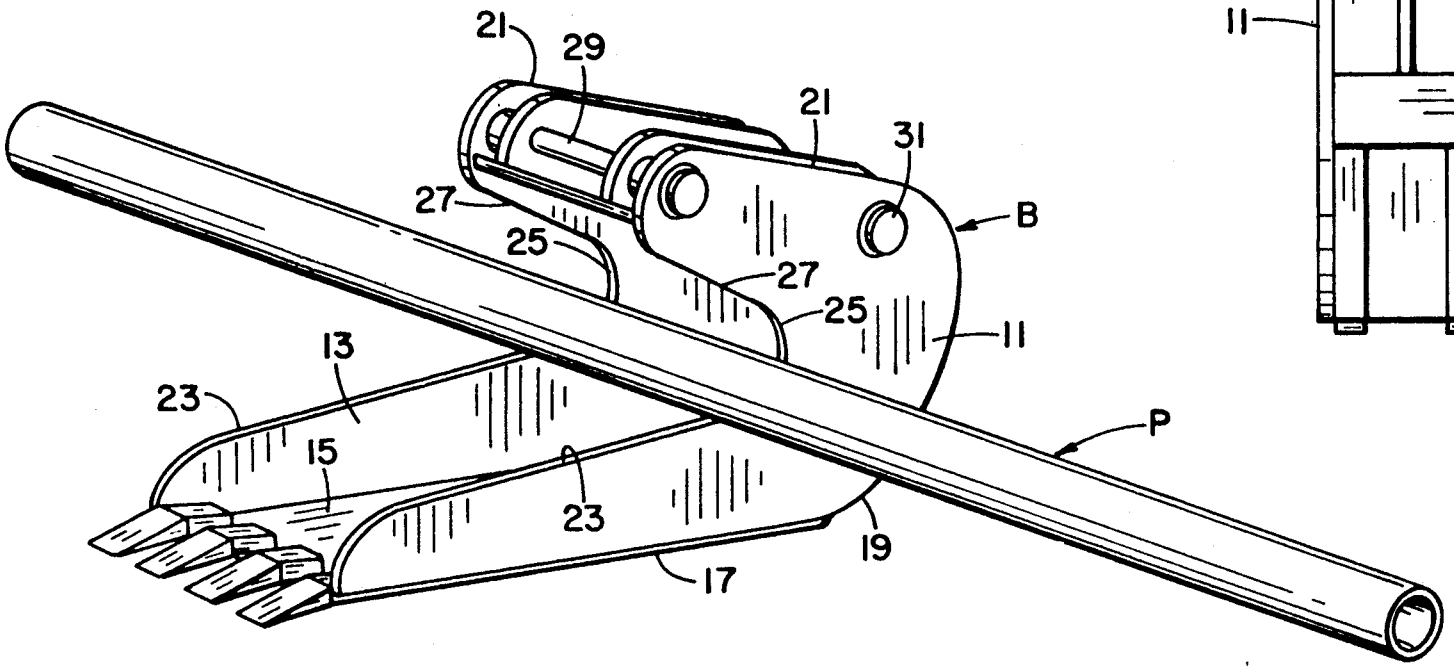
FIG. 4 is a perspective view of the utilities bucket of FIG. 1. While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

A preferred embodiment of a bucket for excavating beneath buried utility lines is illustrated in FIGS. 1 through 4. As shown in FIG. 4, the bucket B is designed to permit trenching under a utility line P without the need for any other tools or implements. The bucket B consists of a pair of sides 11 and 13 spaced apart by a digging member 15. Each of the sides 11 and 13 have an exterior edge with an elongated substantially flat base portion 17, an upwardly curving back portion 19 and a top portion 21. Each of the sides 11 and 13 also has an interior edge with an elongated substantially flat base portion 23, an upwardly curving back portion 25 and a top portion 27. The radius of curvature of the exterior back portion 19 progressively increases as the curve extends from the base portion 17 to the top portion 21.

Conversely, the radius of curvature of the interior back portion 25 progressively decreases as the curve extends from the base portion 23 to the top portion 27. Extending between the top portions of the sides 11 and 13 are a pair of couplers 29 and 31 used to connect the bucket B to its operating equipment (not shown). The couplers 29 and 31 are disposed between their respective interior and exterior edge top portions 21 and 27 along a plane 33 angularly displaced in relation to the exterior edge base portion 17. The plane 33 and the progressive radii of the back portions 19 and 25 are coordinated so as to simultaneously permit a utility line P to clear the inside edge of the bucket B and the excavation to clear the outside edge of the bucket B as the bucket B rotates about the coupling means 29 and 31.

The elongated base of the bucket B permits excavation beneath and beyond existing utility lines without use of any implements other than the bucket B. The radial relationships of the interior and exterior edges of the bucket permit the rotation of the bucket B into and out of position with the utility line P cradled in the interior back portion 23 of the bucket B without contact with or damage to the utility line P.

Thus, it is apparent that there has been provided, in accordance with the invention, a bucket for excavating beneath buried utility lines that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed as new is as follows:

1. A bucket for excavating beneath buried utility lines comprising a pair of side walls spaced apart by a digging wall therebetween, said side walls having interior and exterior edges, each of said exterior edges having an elongated, substantially flat base portion, an upwardly curving back portion of progressively increasing radius and a top portion and each of said interior edges having an elongated, substantially flat base portion, an upwardly curving back portion of progressively decreasing radius and a top portion, said interior edge top portion joining said exterior edge top portion, each of said side walls having a pair of means for coupling said bucket to an operating means, each said pair of coupling means being disposed between respective interior and exterior edge top portions along a plane angularly displaced in relation to said exterior edge base portions, said plane and said radii being coordinated to simultaneously permit the utility lines to clear said inside edges and the excavation to clear said outside edges as said bucket rotates about said coupling means.

2. A bucket according to claim 1, said upwardly curving back portion of said interior edges forming a pocket for receiving said utility line transversely therein with said elongated base portions extending substantially beyond said utility line.

* * * * *